United States Patent [19]

Abrams

[11] 4,136,484

[45] Jan. 30, 1979

[54] STUFFED DOLL WITH BENDABLE FRAMEWORK AND METHOD OF MAKING FRAMEWORK

[75] Inventor: D. David Abrams, Kowloon, Hong Kong

[73] Assignee: Mego Corp., New York, N.Y.

[21] Appl. No.: 867,528

[22] Filed: Jan. 6, 1978

[51] Int. Cl.[2] ..... A63H 3/02; A63H 3/04

[52] U.S. Cl. ..... 46/160; 29/526 R

[58] Field of Search ..... 46/151, 160, 162, 173; 29/526

[56] References Cited

U.S. PATENT DOCUMENTS

| | | | |
|---|---|---|---|
| 1,590,898 | 6/1926 | McAuley | 46/160 |
| 2,219,130 | 10/1940 | Herrmann | 46/162 |
| 3,071,894 | 1/1963 | Frye | 46/175 R |

FOREIGN PATENT DOCUMENTS

| | | | |
|---|---|---|---|
| 1029274 | 4/1958 | Fed. Rep. of Germany | 46/151 |
| 612385 | 7/1926 | France | 46/162 |
| 1169501 | 9/1958 | France | 46/151 |
| 632427 | 11/1949 | United Kingdom | 46/156 |

*Primary Examiner*—F. Barry Shay

*Attorney, Agent, or Firm*—Bertram Frank

[57] ABSTRACT

Improvements are provided in the internal framework of a stuffed bendable doll. The improved bendable framework in at least a portion of the interior of the doll consists of at least one linear framework member consisting of flexible metal wire coated with an external annular layer of flexible resilient plastic. The combination of central metal wire and annular plastic layer is preferably formed by extrusion of wire stock with in situ deposition of the outer plastic layer. The linear framework member typically extends centrally and longitudinally through a limb of the doll, so that the limb is bendable, and the terminal end of the member at the outer terminus of the limb is retroflexed so that the terminal end of the wire portion of the member is bent away from direct contact with the outer terminus of the limb. An entire internal framework of specific configuration and held together by at least one metal clip is also provided.

12 Claims, 4 Drawing Figures

STUFFED DOLL WITH BENDABLE FRAMEWORK AND METHOD OF MAKING FRAMEWORK

BACKGROUND OF THE INVENTION

1. Field of the Invention

A stuffed bendable doll.

2. Description of the Prior Art

Stuffed dolls provide a great deal of happiness and enjoyment for children, especially for small children, since a stuffed doll simulates, to a greater or lesser extent, the feel and resiliency of an actual living person or character. Thus, the simulation of playing with a living person or character rather than with an inanimate object is attained to a certain extent, and greater enjoyment is provided to the child. Such dolls are readily produced at low cost, and these dolls are typically provided with a stuffing of foamed rubber or plastic, cotton, excelsior, sawdust, urethane, or any other soft material which provides a consistency and resilience. The covering of the stuffed doll is typically a layer of fabric skin in the desired shape, which may be composed of cloth such as cotton, wool, rayon, polyester, or the like, or the outer layer may be composed of thin plastic film such as polyvinyl chloride, polyethylene, polypropylene, or the like. Other materials of construction for the stuffing and skin may be utilized in suitable instances.

In any case, the skin or covering of the doll is usually either dyed or otherwise colored, or provided with suitable appurtenances such as pockets, to simulate the appearance of clothing. The head of the doll will usually be provided with simulated hair as well as appurtenances resembling eyes, nose, mouth and ears, so as to complete the simulation of a human being.

Bendable dolls are also extremely attractive to children, since in this case the limbs and/or the head and/or the torso may be bent by the child at play into a variety of dispositions and positions, so as to simulate a sitting doll, a standing doll, a walking doll, a doll with arms outstretched, etc., with internal structure being provided so that the doll, when once bent into a desired shape or position by the child, tends to remain in that shape or position. Such dolls are commonly known as posable dolls. However, the most common bendable doll does not have an internal frame, and in such dolls, the head and/or the limbs lack the inherent ability to remain in a set or desired position, i.e., unless the doll is externally supported, the head or limbs return to their original positions.

A stuffed bendable doll is shown and described in U.S. Pat. No. 3,955,309 and U.S. patent application Ser. No. 807,928 filed June 21, 1977. Other dolls are disclosed in U.S. Pat. Nos. 3,866,350; 3,624,691 and 2,209,791.

SUMMARY OF THE INVENTION

Purposes of the Invention

It is an object of the present invention to provide an improved stuffed bendable doll.

Another object is to provide a stuffed bendable doll with an improved bendable internal framework.

A further object is to provide a more life-like stuffed bendable doll.

An additional object is to enhance the enjoyment of children, by providing an improved stuffed bendable doll with a more like-like and resilient internal framework in at least one limb.

An object is to provide a stuffed bendable doll having a body and limbs which can be bent into desired positions.

A further object is to provide an internal framework for a stuffed bendable doll which will not deteriorate through prolonged use.

Still another object is to provide an improved stuffed bendable doll in which the internal framework component is cheaply and readily manufactured and assembled, so that the doll can be economically manufactured and sold at low cost.

Still another object of the present invention is to provide an internal frame for a stuffed bendable doll which is of a unitary construction.

A yet further object is to provide a stuffed bendable doll which is of simplified construction and which can be economically manufactured.

An object is to provide a stuffed bendable doll in which the terminal ends of the internal framework do not tend to work or tear through the respective limbs.

An object is to provide a stuffed bendable doll having a bendable internal framework which is cheaper and faster to produce than the frameworks of the prior art.

These and other objects and advantages of the present invention will become evident from the description which follows.

BRIEF DESCRIPTION OF THE INVENTION

In the present invention, a stuffed bendable doll is provided with an improved bendable framework in at least a portion, i.e., along a limb, of the interior of the doll. The invention basically entails the provision of at least one linear framework member having a central core consisting of flexible metal wire, coated with an external annular layer of flexible resilient plastic. The improved bendable framework typically extends centrally and longitudinally throughout the interior of the doll, and is typically composed of a plurality of members as described supra, at least one of the members extending generally centrally and longitudinally through each limb of the doll, so that all of the limbs of the doll are bendable. At least one of the members extends through the torso of the doll. The combination of central metal wire and annular plastic layer is typically pre-formed by extrusion of wire stock with in situ deposition of the plastic layer.

The metal of which the metal wire is composed is typically steel, iron, copper, brass or aluminum. The plastic coating is a flexible resilient plastic such as polyvinyl chloride, polyvinyl acetate, polyethylene, polypropylene, high impact polystyrene, i.e., a copolymer of butadiene and styrene, polystyrene, a polycarbonate, or ABS, an acrylonitrile-butadiene-styrene copolymer.

Generally a linear framework member extends substantially centrally and longitudinally through at least one or all of the limbs of the doll, so that the limb or limbs are bendable. Typically the terminal end of the linear framework member at the outer terminus of the limb is retroflexed, so that the terminal end of the wire portion of the member is bent away from direct contact with the outer terminus of the limb. The reason for this is so that the terminal end of the linear framework member cannot tend to work or tear through the respective limb.

In most instances, a plurality of linear framework members will be provided, with a linear framework member extending centrally and longitudinally through each limb of the doll. In this case, the plurality of members will generally be held together by at least one clip which in most instances, is a rigid metal clip. The clip will usually extend between two parallel and juxtaposed rectilinear lengths of members, and the clip is typically of oblong shape in cross-section, with semi-circular ends.

In a preferred embodiment, the number of linear framework members is two, with each member including a first portion which extends laterally through an arm of the doll, and a second portion which depends from the inner end of the first portion through the torso of the doll and through a leg of the doll. The two members are typically joined proximately at the junction between each first and second portion. Each junction preferably entails a first section and a second section. The first section of the junction depends generally perpendicularly from the inner end of the first portion of a member to one end of the second section. The second section extends laterally, at an acute angle relative to the first section and in a common plane with the first section and the first portion, from the one end to an other end which is joined to the inner end of the second portion of the member. Preferably, each first section is joined to an inner end of the opposite second portion of the other member, so that the two second portions are generally parallel within the torso of the doll. As mentioned supra, each first section of a junction is joined to an inner end of a second portion of the other member by a metal clip.

The present invention provides several salient advantages. The improved stuffed bendable doll framework is cheaply and rapidly produced by mass production methods. Thus the enjoyment of children is enhanced by the provision of an inexpensive stuffed bendable doll. The present doll has a more life-like and resilient flexible inner framework. Thus the doll has a body and limbs which can easily be bent into desired positions and which will not deteriorate through prolonged use. The internal framework component is cheaply and readily manufactured and assembled, so that the doll can be economically manufactured and sold at low cost. The internal frame is of a unitary and simplified construction. In a preferred embodiment, the terminal ends of the internal framework do not tend to work or tear through the respective limbs, by virtue of being retroflexed. The bendable internal framework is cheaper and faster to produce than the frameworks of the prior art.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
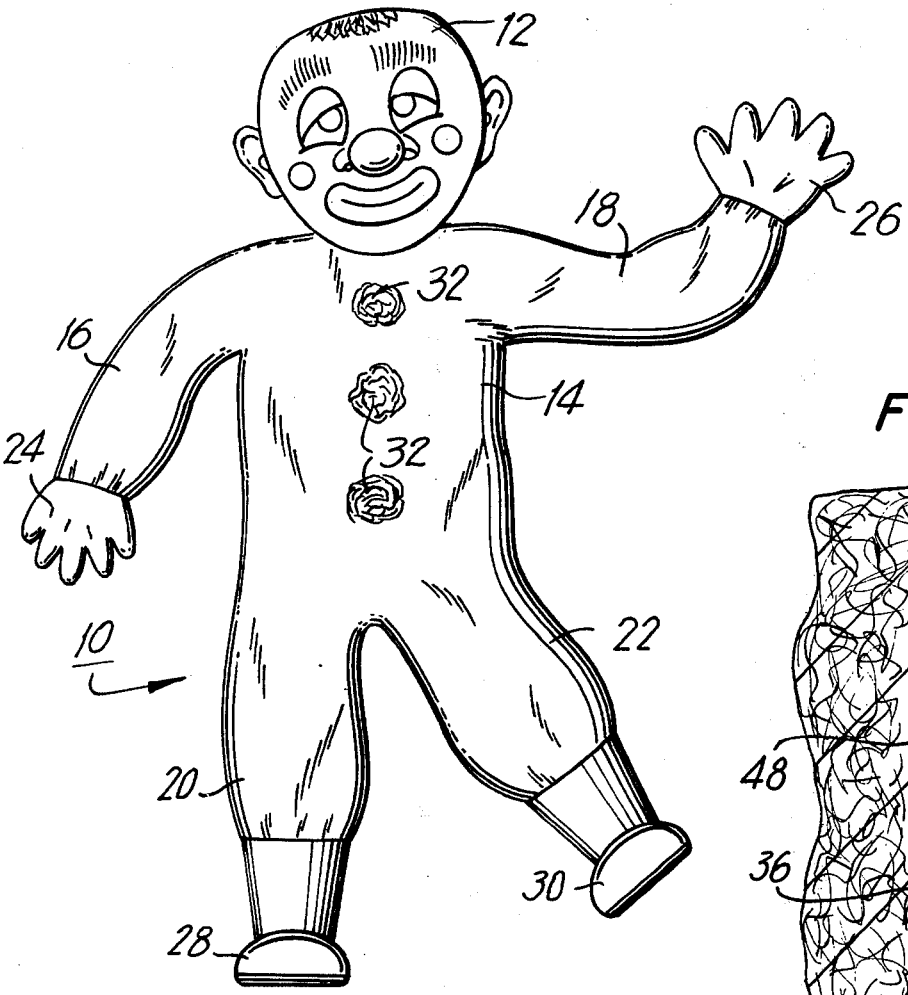
FIG. 1 is an elevation view of a typical stuffed bendable doll, with the left arm and left leg being bent.
Figure 2:
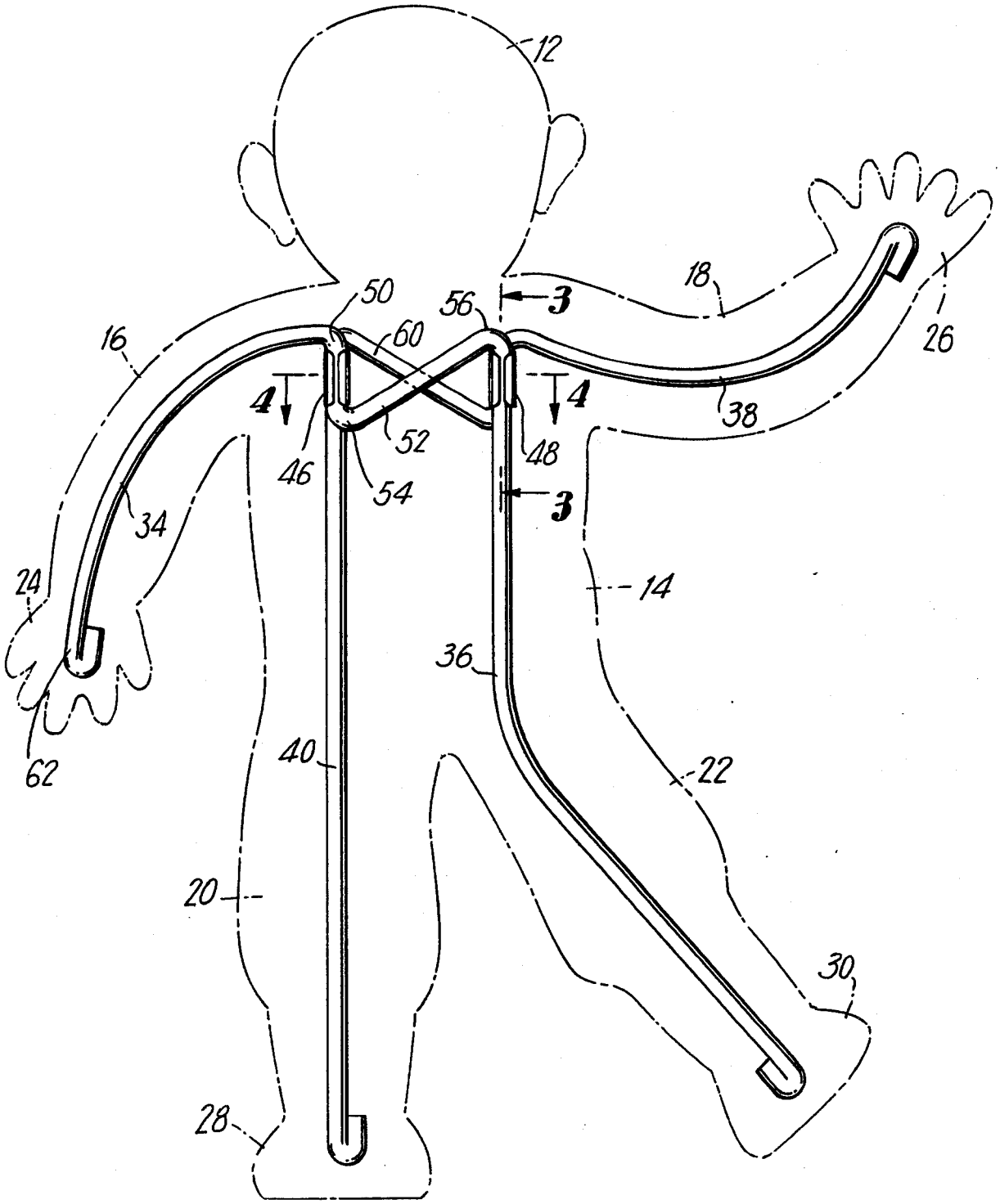
FIG. 2 is an elevation view showing the doll of FIG. 1 in phantom outline and the improved bendable framework of the present invention.

Referring now to FIGS. 1 and 2, the doll 10 is a stuffed bendable doll having an internal bendable framework, stuffing about the framework, and an outer skin or covering. The stuffing and the outer covering may be composed of any of the materials mentioned supra. The doll 10 is provided with a head 12, a torso 14, and two arms 16 and 18 and two legs 20 and 22 which extend from the torso. Terminal hands 24 and 26 are provided at the outer end of, respectively, arms 16 and 18; and terminal feet 28 and 30 are provided at the outer end of, respectively, legs 20 and 22. The head 12 is provided with the features of a human head, namely that of a clown, which is a character to which all children readily relate. In addition, vertically aligned pompons 32 are provided on the front of the torso 14 to further enhance the simulation of the costume of a clown. The doll 10 is shown with arm 18 and leg 22 being bent as if the clown character were performing.

Figure 3:
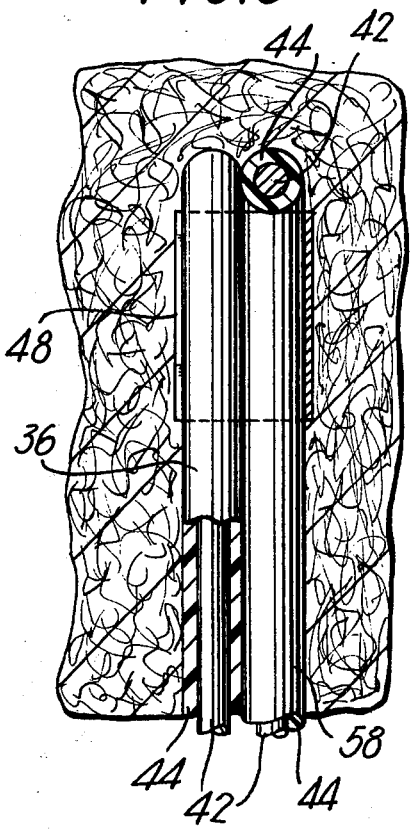
FIG. 3 is a partial sectional elevation view taken substantially along the line 3—3 of FIG. 2.
Figure 4:
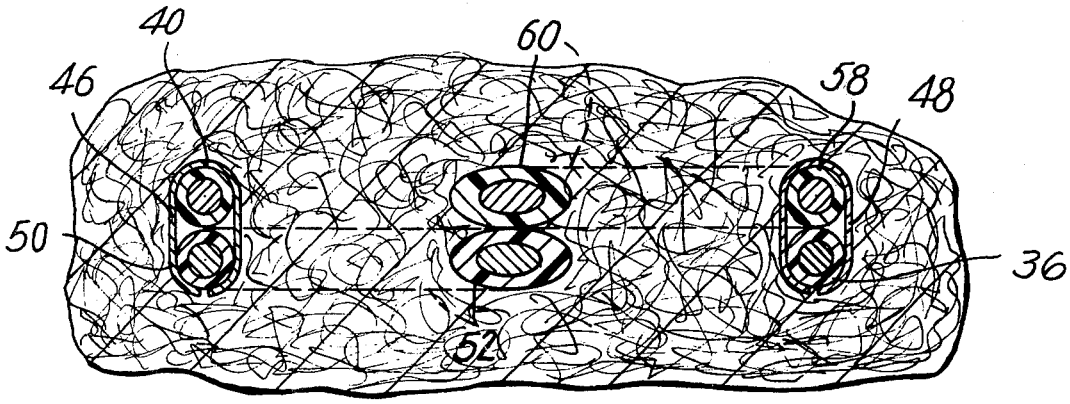
FIG. 4 is a partial sectional plan view taken substantially along the line 4—4 of FIG. 2.

FIGS. 2, 3 and 4 show details of the present bendable internal framework, which basically consists in this case of two members having substantially identical configurations, and held together in generally mirror image orientation to each other by two clips. A first member has a first portion 34 which extends laterally from the torso 14 through arm 16, and a second portion 36 which depends from the inner end of first portion 34 through the torso 14 and the leg 22. Similarly, a second member has a first portion 38 extending through arm 18 and a second portion 40 which extends through torso 14 and leg 20. The portions 34, 36, 38 and 40 are linear framework members having a central core consisting of flexible metal wire coated with an external annular layer of flexible resilient plastic, so that each of these portions, which extend substantially centrally and longitudinally through their respective limb of the doll, are bendable. Central cores and annular plastic layers are best seen in FIGS. 3 and 4, e.g., central core 42 and annular layer 44 (FIG. 3).

The two members are joined proximately at the junction between each first and second portion, which junction is of a specific configuration as will appear infra, by two metal clips 46 and 48. Each metal clip 46 or 48 extends between two parallel and rectilinear lengths of the linear framework members, and each clip is of oblong shape in cross-section (FIG. 4) with semi-circular ends to conform to the curvature of the outer surface of each linear framework member, which is circular, i.e., the linear framework members are cylindrical.

Each junction between a first and a second portion of a member is of specific configuration to accommodate the joining of the members by means of the clips 46 and 48. Thus the junction between portions 34 and 36 of the first member consists of a first section 50 and a second section 52. The first section 50, as best seen in FIG. 2, is mostly embraced by the clip 46, and section 50 depends substantially perpendicularly from the inner end of the first portion 34 to one end 54 of the second section 52. The second section 52 extends laterally at an acute angle relative to the first section 50 from the one end 54 to an other end 56 which is joined to the inner end of the second portion 36. A similar first section 58 (FIG. 3) and second section 60 are provided for the junction between portions 38 and 40. Each first section 50 or 58 is joined to an inner end of the opposite second portion 40 or 36 of the other member by a clip 46 or 48, so that the two second portions 40 and 36 are substantially parallel within the torso 14 of the doll 10, as best seen in FIG. 2.

In this preferred embodiment of the invention, the terminal end of each linear framework member at the outer terminus of a limb is retroflexed, e.g., terminal end 62 of member 34 is retroflexed within hand 24. Thus the terminal end of the wire portion of the member portion 34 is bent away from direct contact with the outer terminus hand 24 of limb 16, and therefore the wire end cannot tend to work or tear through the limb 16 or hand 24. As shown in FIG. 2, the terminal ends of member portions 36, 38 and 40 within their respective terminal limb members 30, 26 and 28 are also retroflexed.

Each framework member portion and section consists of central metal wire and annular plastic layer, as best seen in FIG. 4. The members are preferably formed by extrusion of wire stock with in situ deposition of the plastic layer, and the metal and plastic materials of construction are preferably as mentioned supra. The method of manufacturing the framework entails extruding metal wire stock with an outer annular plastic layer, cutting the wire stock to length, bending each length of wire stock to shape, and attaching the lengths together by metal clips 46 and 48 as described supra to form the framework. Each end of each length of wire stock is bent, i.e., retroflexed, so that no sharp wire end is present.

It thus will be seen that there is provided a stuffed bendable doll which achieves the various objects of the invention and wich is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A stuffed bendable doll having a bendable linear framework, said doll including a pair of arms and a pair of legs connected to a torso, said framework comprising:

a pair of flexible wires, each said wire coated with an annular layer of flexible reslient plastic, one of said wires extending substantially centrally and longitudinally through each limb of said doll, each said wire having a first portion extending from one of said arms, a second portion extending from one of said legs and a junction connecting said first and second portions, each said junction comprising a first section and a second section, each said first section depending substantially perpendicularly from the inner end of the associated first portion to one end of the associated second section, each said second section extending laterally at an acute angle relative to it's associated first section and further extending substantially parallel to said first section from said one end to another end which is joined to the inner end of the respective second portion, said two wires being joined to each other at said junctions.

2. The stuffed bendable doll in accordance with claim 1 wherein the first section of one of said pair of wires is coupled to the second section of the other member of said pair of wires and vice-versa, so that the two junctions are substantially parallel within the torso of the doll.

3. The stuffed bendable doll in accordance with claim 2 wherein the junctions of said pair of wires are coupled by a clip.

4. The stuffed bendable doll of claim 3 in which the clip is a metal clip.

5. The stuffed bendable doll of claim 3 in which the clip is of oblong shape in cross-section, with semi-circular ends.

6. The stuffed bendable doll in accordance with claim 1 wherein the terminal end of each of said pair of wires is retroflexed so that the terminal ends of the wire portion of the resilient plastic coated flexible wires are bent away from direct contact with the outer terminuses of the arms and legs.

7. The stuffed bendable doll of claim 1 in which the combination of central metal wire and annular plastic layer is formed by extrusion of wire stock with in situ deposition of the plastic layer.

8. The stuffed bendable doll of claim 1 in which the metal is selected from the group consisting of steel, iron, copper, brass and aluminum.

9. The stuffed bendable doll of claim 1 in which the plastic is selected from the group consisting of polyvinyl chloride, polyvinyl acetate, polyethylene, polypropylene, a copolymer of butadiene and styrene, polystyrene, a polycarbonate, and an acrylonitrile-butadiene-styrene copolymer.

10. A method of manufacturing a framework for a stuffed bendable doll including the steps of:

1. extruding flexible wire with deposition of an outer annular resilient plastic coating.
2. cutting said wire into predetermined lengths.
3. bending a pair of said lengths of wire to substantially a right angular bend at a first predetermined distance from one end of each of said wires,
4. bending said pair of wires a second predetermined distance from their respective right angular bends to substantially equal acute angular bends,
5. bending said pair of wires a third predetermined distance from their respective acute angular bends so that the remaining portion of said wire lengths are substantially parallel to the portions formed by step 3,
6. inverting one of said pair of wires and placing it atop of the other of said pair of wires so that the corresponding parallel portions of said pair of wires are substantially in overlying relation to each other, and
7. coupling the upper of said pair of wires to the lower of said pair of wires along the substantially parallel, overlying portions of said lengths.

11. The method of manufacturing a framework for a stuffed bendable doll in accordance with claim 10 including the step of retroflexing the ends of the predetermined lengths of wire.

12. A method of manufacturing a stuffed bendable doll in accordance with claim 11 and including the step of covering said coupled wire pair with stuffing and an outer skin.

* * * * *